US005851104A

United States Patent [19]

Dakin et al.

[11] Patent Number: 5,851,104

[45] Date of Patent: Dec. 22, 1998

[54] NOZZLE ADJUSTING MECHANISM

[75] Inventors: Robin M. Dakin, Los Angeles; Behrooz Ershaghi, Irvine, both of Calif.

[73] Assignee: Atlas Copco Rotoflow, Inc., Gardena, Calif.

[21] Appl. No.: 990,358

[22] Filed: Dec. 15, 1997

[51] Int. Cl.[6] ..... F01B 25/02

[52] U.S. Cl. ..... 415/150; 415/164

[58] Field of Search ..... 415/150, 151, 415/159, 160, 163, 164, 165, 166

[56] References Cited

U.S. PATENT DOCUMENTS

| | | | |
|---|---|---|---|
| 3,232,581 | 2/1966 | Swearingen | 415/163 X |
| 3,495,921 | 2/1970 | Swearingen | 415/163 |
| 4,242,040 | 12/1980 | Swearingen | 415/163 X |
| 4,355,953 | 10/1982 | Nelson | 415/164 |
| 4,502,836 | 3/1985 | Swearingen | 415/160 X |
| 5,564,895 | 10/1996 | Agahi et al. | 415/164 X |

FOREIGN PATENT DOCUMENTS

| | | | |
|---|---|---|---|
| 1121235 | 3/1955 | France | 415/163 |
| 60-175705 | 9/1985 | Japan | 415/160 |

*Primary Examiner*—John E. Ryznic
*Attorney, Agent, or Firm*—Lyon & Lyon LLP

[57] ABSTRACT

An adjusting mechanism for the annular inlet of a radial inflow turbine employing a rotatably mounted adjusting ring as one side of the annular inlet with cams and biased slots controlling primary vanes located within the inlet. A clamping ring which is capable of moving axially is located inwardly of the adjusting ring. A bearing piston ring is mounted to the clamping ring and supports the adjusting ring. The bearing ring also provides some sealing capabilities. A sealing ring between the clamping ring and the housing accommodates some small axial movement of the clamping ring and seals against substantial pressure differential between the inlet and outlet of the nozzle itself. Pins extend across the annular inlet to pivotally mount the primary vanes.

22 Claims, 3 Drawing Sheets

NOZZLE ADJUSTING MECHANISM

BACKGROUND OF THE INVENTION

The field of the present invention is radial inflow turbines and, more specifically, variable primary nozzle systems for such turbines.

Radial inflow turbines employ an annular inlet surrounding a turbine wheel through which influent under pressure is directed. To uniformly distribute the influent, primary, vanes are disposed about the annular inlet to create a nozzle. These nozzles are often variable through the controlled pivotal motion of the primary vanes.

The primary vanes are typically mounted between mounting rings which are positioned in the housing to either side of the annular inlet. One of the mounting rings may be rotatably mounted relative to the other. The rotatably mounted ring typically has biased slots which receive pins fixed in the vanes at a distance laterally from the pivotal mountings of the vanes. Rotational movement of the mounting ring results in pivoting of the vanes to adjust the nozzle opening. A pneumatic, electric or hydraulic cylinder is associated with the rotatable mounting ring to forcefully control the position of the mounting ring, in turn controlling the vanes. One such system is presented in U.S. Pat. No. 5,564,895 directed to ACTIVE AUTOMATIC CLAMPING CONTROL, the disclosure of which is incorporated herein by reference. Another is presented in U.S. Pat. No. 3,495,921 directed to VARIABLE NOZZLE TURBINE, the disclosure of which is incorporated herein by reference.

Because of the inherent pressures in such radial turbines, particularly the static and dynamic pressures of the flow through the primary nozzle, clamping forces are applied by the mounting rings to the sides of the vanes adjacent the mounting rings. One of the mounting rings is also typically mounted for axial movement. Normally, one ring is fixed while the other is allowed to move axially. A close fit of the rings about the vanes prevents the occurrence of "blow-by," i.e., direct leakage flow from the source of pressure in the inlet to the turbine wheel, bypassing the nozzle and reducing turbine efficiency. Thus, clamping forces reduce such blow-by. However, the resulting clamping forces can become excessive. Actuation of the vanes to adjust the nozzle then is inhibited.

Methods to control clamping forces are disclosed in U.S. Pat. No. 4,502,836, directed to Method for Nozzle Clamping Force Control, and U.S. Pat. No. 5,564,895, directed to Active Automatic Clamping Control, the disclosures of which are incorporated herein by reference. In the referenced patents, fluid pressure is employed on the back side of the floating mounting ring to actively control the clamping force in order that adjustments can be made to the position of the primary vanes.

SUMMARY OF THE INVENTION

The present invention is directed to nozzle design for primary nozzle systems in radial inflow turbines. The design contemplates separate rings for nozzle adjustment and sealing of the nozzle through clamping of the primary vanes.

In a first, separate aspect of the present invention, a nozzle adjustment mechanism for a radial inflow turbine includes an adjusting ring and a clamping ring. The adjusting ring is rotatably mounted in the housing while the clamping ring is mounted to be slidable axially in the housing. The use of a separate adjusting ring and a separate clamping ring provide for substantial elimination of blow-by and at the same time allow the adjusting mechanism to avoid binding the primary vanes.

In a second, separate aspect of the present invention, the features of the first aspect are enhanced through the cooperation of both a sealing piston ring and a bearing piston ring. The sealing piston ring is to be between the clamping ring and the housing of the turbine while the bearing piston ring supports the adjusting ring. With the sealing piston ring associated with the clamping ring, avoidance of blow-by around the mechanism can be achieved. The bearing piston ring can support as well as seal the adjusting ring. The adjusting ring is preferably located radially outwardly in the annular nozzle from the clamping ring. Thus, the sealing piston ring experiences the greatest pressure differential in the nozzle area while the bearing piston ring experiences reduced pressure differentials. With the bearing piston ring acting principally as a bearing support with only reduced differential pressures across the ring, less friction is to be encountered.

In a third, separate aspect of the present invention, the features of the first aspect, and separately the second aspect, are enhanced through relief on the adjusting ring to displace much of the surface area adjacent the nozzle assembly from the primary vanes. This reduces friction surface area and resisting moment arm which can interfere with the pivotal adjustments of the primary vanes where sealing is not needed.

In a fourth, separate aspect of the present invention, mounting of the primary vanes in a radial inflow turbine with a nozzle adjusting mechanism contemplates a cam and cam follower mechanism mounted to the primary vanes and the adjusting ring. The cams may be biased slots in one or the other of these components which receive the cam followers such that rotation of the adjusting ring will cause adjustments in the primary vanes. The cam followers may be rotatably mounted such that lower friction is encountered in the adjustment mechanism. As in prior aspects, a separation of the adjusting function and the clamping function between rings allows the primary vanes to be pivotally mounted between the two sides of the nozzle area by a pivot pin extending into the housing on one side and into the clamping ring on the other. Cantilevering forces are eliminated through such mountings.

In a fifth, separate aspect of the present invention, the assembly of any of the foregoing aspects as part of a radial inflow turbine is contemplated.

In a sixth, separate aspect of the present invention, any of the foregoing aspects are contemplated to be combined in an advantageous assembly to improve inflow turbine efficiency. Primary vanes may be pivoted under minimum clamping forces exerted on the adjusting mechanism. Hunting due to fast and small changes in process flow is avoided and finer process controls can be achieved through lower actuation force. Smaller actuators are possible and fewer primary vanes may be employed.

Accordingly, it is an object of the present invention to provide an improved radial inflow turbine with an improved variable nozzle system. Other and further objects and advantages will appear hereinafter.

DETAILED DESCRIPTION OF THE PREFERRED EMBODIMENT

Figure 1:
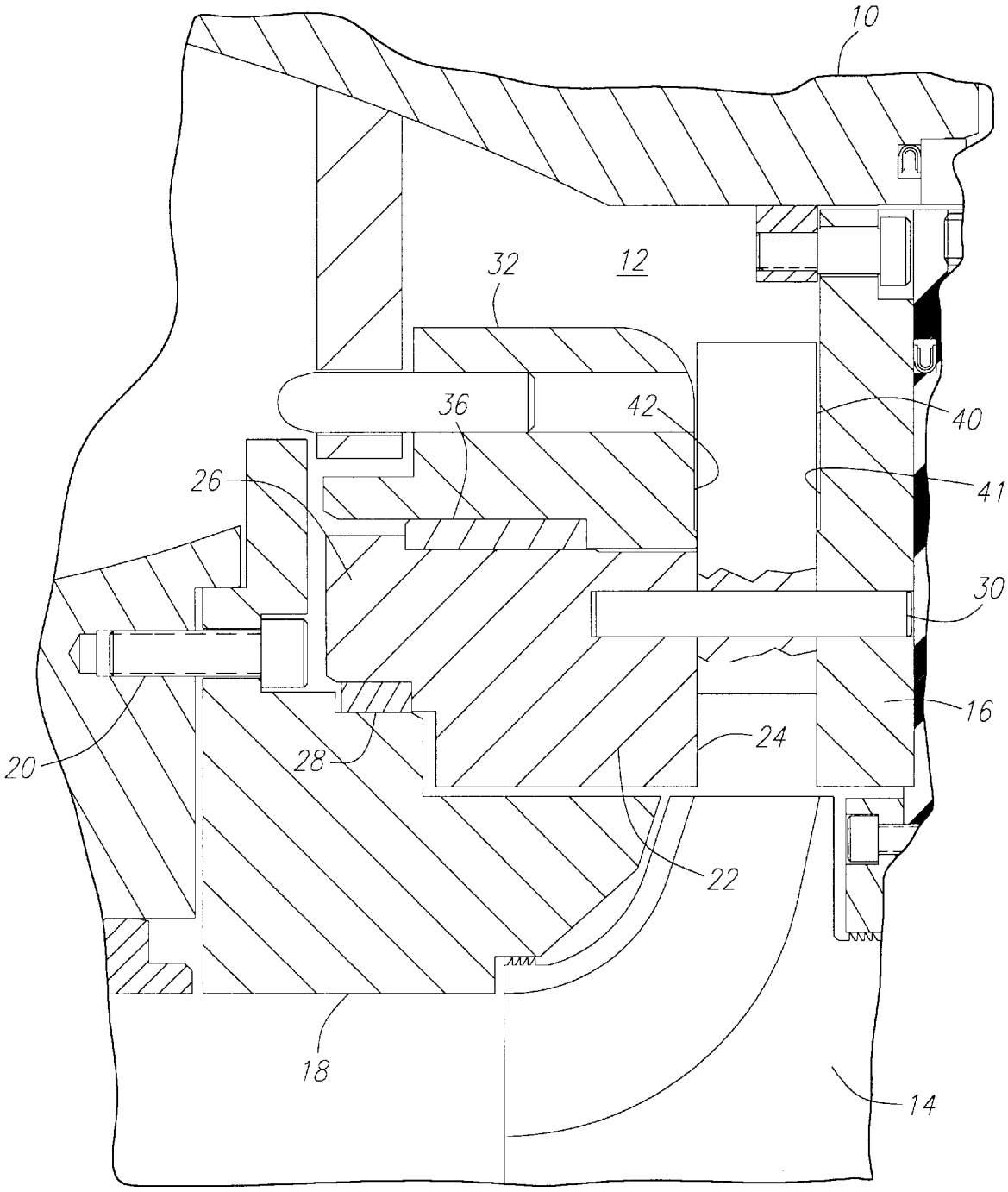
FIG. 1 is a cross-sectional view of a variable nozzle system.

Turning in detail to the drawings, a variable nozzle arrangement in a radial inflow turbine is illustrated in FIG.

1. The radial inflow turbine is shown to have a housing 10 with an annular inlet 12. The annular inlet preferably extends fully about a rotatably mounted turbine wheel 14 centrally mounted within the housing 10. A fixed circular plate 16 is positioned to one side of the annular inlet 12. An active mounting mechanism and nozzle adjustment system is provided to the other side of the annular inlet 12. A housing ring 18 is shown bolted to the housing 10 at a lower portion of the inlet 12. This housing ring 18 surrounds the turbine wheel 14 and provides a base for the active side of the inlet mounting system. Fasteners 20 retain the housing ring 18 in position.

A clamping ring 22 is positioned about the housing ring 18. The clamping ring 22 includes a nozzle face 24. A mounting ring 26 extends integrally from the opposite side of the clamping ring 22. A sealing piston ring 28 extends between an exterior circumferential surface on the housing ring 18 and an interior annular surface on the mounting ring 26. The sealing piston ring 28 is preferably of low friction material such as PTFE. As the housing ring 18, the sealing piston ring 28 and the mounting ring 26 of the clamping ring 22 are concentrically arranged, a telescoping or axial movement can occur between the clamping ring 22 and the housing ring 18. Rotational movement is prevented by nozzle pivot pins 30 which extend across the inlet 12. As the clamping ring 22 is subjected to only very small movement when in operation, sliding friction is not encountered to any great extent and a substantial seal may be provided through the fit of the components without creating a problem.

An adjusting ring 32 is arranged radially outwardly of the clamping ring 22. The adjusting ring 32 fits closely with a small gap about the clamping ring 22. Within the gap, a cavity is provided which is defined by a step in each of the outer surface of the clamping ring 22 and the inner surface of the adjusting ring 32. The steps in these surfaces are displaced to form the annular cavity. This annular cavity receives a bearing piston ring 36. The bearing piston ring 36 is principally designed to provide bearing support for rotation of the adjusting ring 32 through a relatively small angle. This bearing piston ring 36 also provides a sealing function between the clamping ring 22 and the adjusting ring 32. However, as differential pressures across this part of the nozzle are lower than those experienced by the sealing piston ring 28, the sealing function is not as great. Consequently, the fit of these components may be looser so as to avoid substantial sliding friction. As the components are again concentrically arranged, the adjusting ring 32 is able to rotate about the clamping ring 22 which is prevented from rotating by the nozzle pivot pins 30 anchored in the fixed circular plate 16.

Figure 2:
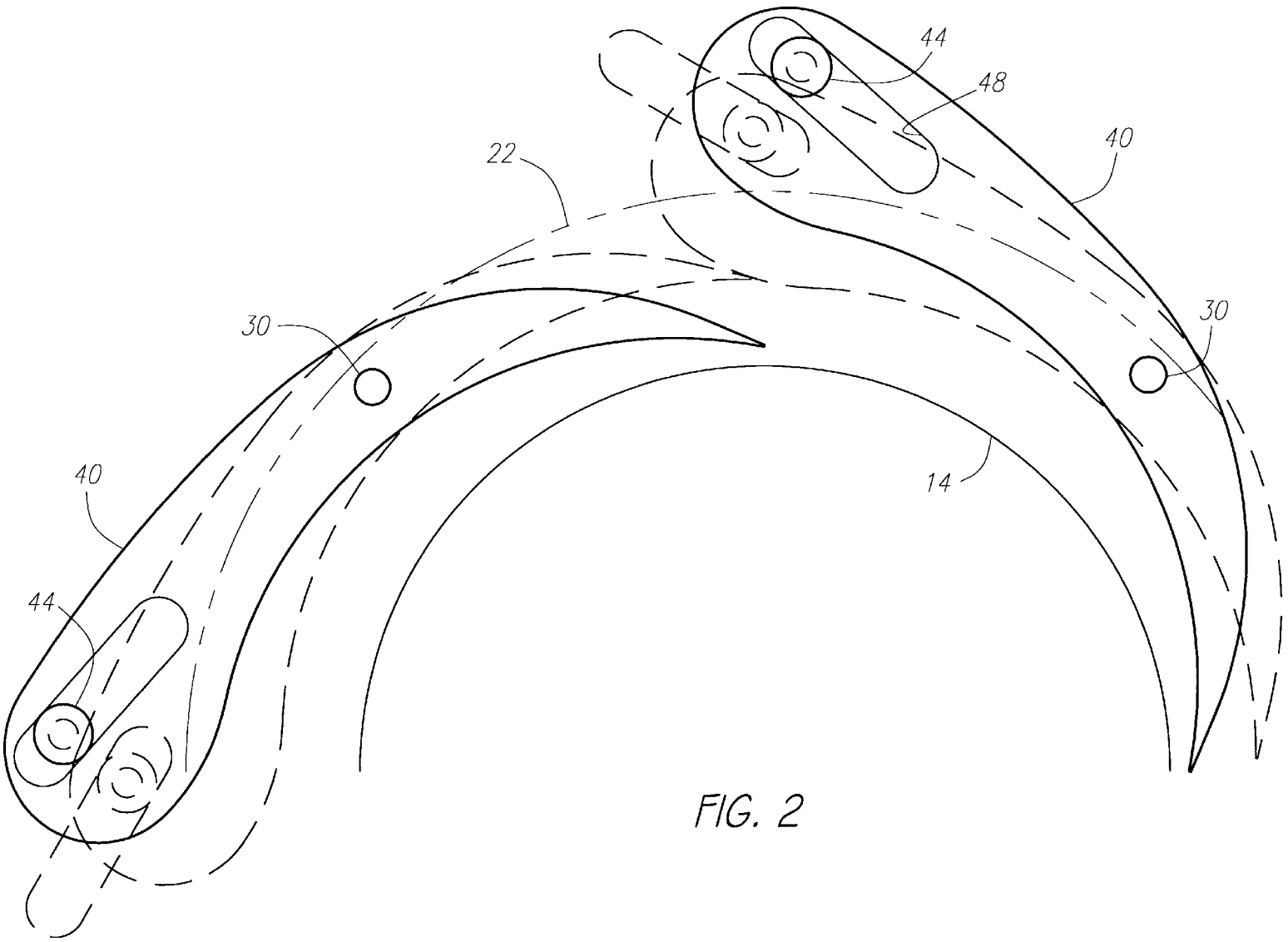
FIG. 2 is a side view of the primary vanes with a second position of the vanes illustrated in phantom.

Primary vanes 40 are located about the annular inlet 12. These vanes are positioned between the fixed circular plate 16 on one side and the clamping ring 22 and adjusting ring 32 on the other. The primary vanes 40 are configured to provide a streamline flow path therebetween. This path may be increased or decreased in cross-sectional area based on the rotational position of the vanes 40. The primary vanes 40 are pivotally mounted about the nozzle pivot pins 30 as indicated above. These pins 30 extend fully through the vanes 40 and into both the circular plate 16 and the clamping ring 22. The relative positioning of the primary vanes 40 to the outer extent of the clamping ring 22 is illustrated by the superimposed phantom line in FIG. 2.

Partial relief is provided to either side of the primary vanes 40 on both the fixed plate 16 and the adjusting ring 32 as can best be seen in FIG. 1. Annular recesses 41 and 42 are provided on the inner surfaces of the fixed plate 16 and the adjusting ring 32, respectively, to provide appropriate relief for pivotal movement of the primary vanes 40. These features reduce the friction surface area and resisting moment arm of these components in areas where sealing is not needed. The relief on the inner surface of the adjusting ring 32 and on the inner surface of the fixed plate 16 does not extend fully to the inner diameter of the adjustment ring 32 so that the adjustment ring 32 is constrained axially by the primary vanes. The area of contact 43 is near the pivot pin 30, near the axis of rotation about which the primary vanes 40 pivot, so that any resisting friction is not operating through an extended moment.

Figure 3:
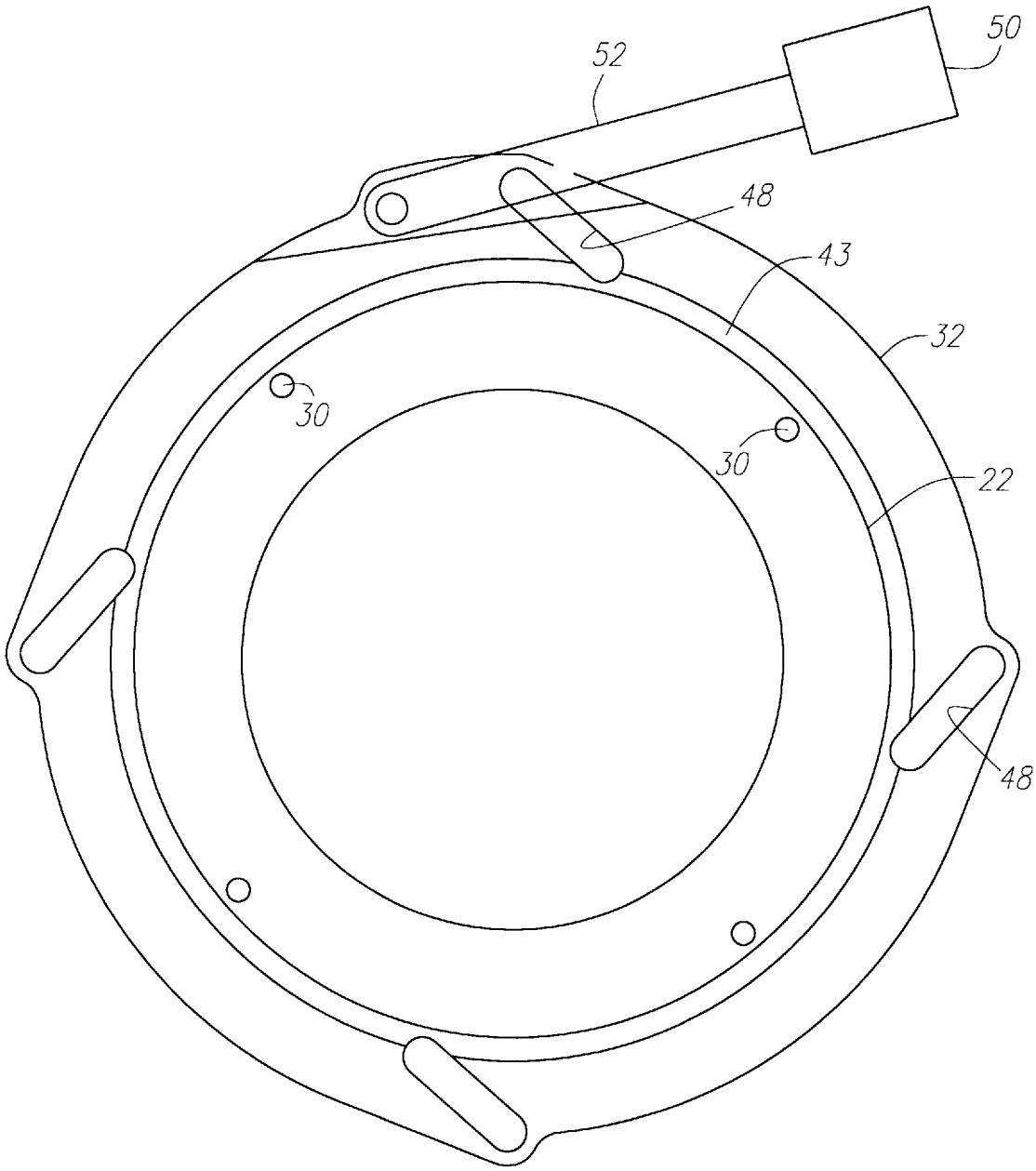
FIG. 3 is a side view of the adjusting ring and clamping ring of the variable nozzle system of FIG. 1.

The nozzle adjusting mechanism includes a cam and cam follower mechanism. Cam followers 44 are displaced laterally from the axis of the pins 30 and are fixed by means of shafts into the primary vanes 40, respectively. The cam followers 44 rotate about the shafts freely. To cooperate with the cam followers 44, cams in the form of biased slots 48 are arranged in the adjusting ring 32 as seen in FIG. 3 and as superimposed on the images of the primary vanes in FIG. 2. These slots 48 do not extend fully through the adjusting ring 32. They are sized to receive the cam followers 44 for free rolling movement as the adjusting ring 32 is rotated. To drive this rotation, a nozzle actuator is employed. The actuator includes a drive 50, which may be a pneumatic actuator, an electric motor or other similar device. The drive 50 is fixed relative to the housing. A rod 52 extends between the drive and the adjusting ring 32 where it is pinned. In this way, translational movement can be changed into rotational movement for adjustment of the adjusting ring 32.

In operation, pressurized fluid is supplied to the annular inlet 12 within the housing 10. This fluid under pressure is accelerated through the annular nozzle defined by the sides of the annular inlet 12 and the primary vanes 40. As the flow moves radially inwardly, velocity increases and pressure drops. As can be seen in FIG. 1, the inlet pressure has access to the back side of the adjusting ring 32. Consequently, there is a pressure differential across the adjusting ring 32. The pressure of the inlet is also provided to a portion of the clamping ring 22 which includes the outer face of the mounting ring 26 as well as the sealing piston ring 28. The remainder of the clamping ring 22 is subjected to the pressure which is at the outlet of the nozzle and substantially reduced. As the clamping ring 22 is able to move axially, it moves toward the primary vanes 40 under the influence of the differential pressure as measured across the area defined by the mounting ring 26 and the sealing piston ring 28. This force is greatly reduced over that which would have been exerted if the clamping ring 22 and the adjusting ring 32 were fixed together. Even so, an axial clamping force is placed on the primary vanes 40 by the clamping ring 22. This clamping force eliminates blow-by around the primary vanes 40.

The adjusting ring 32 is not constrained from moving axially against the vanes 40. However, the lower pressure across the adjusting ring 32 has been found insufficient to bind the primary vanes 40.

The forces to adjust the primary vanes 40 resisting movement of the rod 52 are substantially reduced because of the arrangement. A reduced clamping force does exist on the primary vanes 40 by virtue of the differential pressure across a portion of the adjusting ring 32 as discussed above. This force is both reduced and positioned only about a portion of the primary vanes 40 around the pivot axis through the pins 30 such that there is a small effective moment arm resisting pivotal adjustments. Consequently, resistance to pivoting of the primary vanes 40 is greatly reduced over that of prior systems even with the same pressure differentials experienced within the inlet nozzle. Adjustment forces being reduced, adjustment can be more easily accomplished without significant difficulty. The capacity of the drive may also be reduced in view of the lighter forces required.

Thus, an improved adjusting mechanism for the annular inlet of a radial inflow turbine is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A nozzle adjustment mechanism for a radial inflow turbine having a housing, an annular inlet in the housing and primary vanes in the inlet pivotally mounted relative to the housing, comprising an adjusting ring on a first side of the primary vanes and rotatably mounted in the housing;

a clamping ring on the first side of the primary vanes and axially slidably mounted in the housing;

a sealing piston ring between the clamping ring and the housing.

2. The nozzle adjustment mechanism of claim 1, the clamping ring being fixed angularly in the housing.

3. The nozzle adjustment mechanism of claim 1 further comprising an annular recess between the adjusting ring and the primary vanes.

4. The nozzle adjustment mechanism of claim 1 further comprising a bearing piston ring supporting the adjusting ring.

5. The nozzle adjustment mechanism of claim 1, the adjusting ring being positioned radially outwardly of the clamping ring.

6. The nozzle adjustment mechanism of claim 1 further comprising cams rotatably mounted to one of the primary vanes, respectively, and the adjusting ring, the other of the primary vanes, respectively, and the adjusting ring having biased slots receiving the cams, respectively.

7. The nozzle adjustment mechanism of claim 6, the cams being rotatably mounted to the primary vanes, respectively, and the adjusting ring having biased slots receiving the cams, respectively.

8. The nozzle adjustment mechanism of claim 1 further comprising a nozzle actuator including a drive fixed relative to the housing and a rod coupled with the drive and with the adjusting ring.

9. The nozzle adjustment mechanism of claim 1 further comprising pins mounted relative to the housing and to the clamping ring across the annular inlet, the primary vanes being mounted to the pins for pivotal movement within the housing.

10. A nozzle adjustment mechanism for a radial inflow turbine having a housing, an annular inlet in the housing and primary vanes in the inlet pivotally mounted relative to the housing, comprising an adjusting ring on a first side of the primary vanes and rotatably mounted in the housing;

a clamping ring on the first side of the primary vanes and axially slidably mounted in the housing;

a sealing piston ring between the clamping ring and the housing;

a bearing piston ring supporting the adjusting ring, the bearing piston ring extending between the adjusting ring and the clamping ring.

11. The nozzle adjustment mechanism of claim 10, the adjusting ring being positioned radially outwardly of the clamping ring.

12. The nozzle adjustment mechanism of claim 11, the clamping ring being fixed angularly in the housing.

13. The nozzle adjustment mechanism of claim 10 further comprising cams rotatably mounted to one of the primary vanes, respectively, and the adjusting ring, the other of the primary vanes, respectively, and the adjusting ring having biased slots receiving the cams, respectively.

14. The nozzle adjustment mechanism of claim 10 further comprising pins mounted relative to the housing and to the clamping ring across the annular inlet, the primary vanes being mounted to the pins for pivotal movement within the housing.

15. The nozzle adjustment mechanism of claim 10 further comprising an annular recess between the adjusting ring and the primary vanes.

16. A radial inflow turbine comprising a housing;

an annular inlet in the housing;

primary vanes in the inlet pivotally mounted relative to the housing;

a nozzle adjustment mechanism including an adjusting ring on a first side of the primary vanes and rotatably mounted in the housing;

a clamping ring on the first side of the primary vanes and axially slidably mounted in the housing; and a sealing piston ring between the clamping ring and the housing.

17. The radial inflow turbine of claim 16 further comprising a bearing piston ring supporting the adjusting ring, the bearing piston ring extending between the adjusting ring and the clamping ring.

18. The radial inflow turbine of claim 17, the adjusting ring being positioned radially outwardly of the clamping ring.

19. The radial inflow turbine of claim 18 further comprising a cam mechanism including cam followers rotatably mounted to one of the adjusting ring and the primary vanes, respectively, and biased slots receiving the cam followers, respectively, in the other of the adjusting ring and the primary vanes, respectively.

20. The radial inflow turbine of claim 16 further comprising a cam mechanism including cam followers rotatably mounted to one of the adjusting ring and the primary vanes, respectively, and biased slots receiving the cam followers, respectively, in the other of the adjusting ring and the primary vanes, respectively.

21. The radial inflow turbine of claim 16 further comprising pins mounted relative to the housing and to the clamping ring across the annular inlet, the primary vanes being mounted to the pins for pivotal movement within the housing.

22. The radial inflow turbine of claim 16 further comprising a fixed plate adjacent and on a second side of the primary vanes opposed to the adjusting ring;

an annular recess between the adjusting ring and the primary vanes and between the fixed plate and the primary vanes.

* * * * *